US010863800B1

(12) United States Patent
Lecompte et al.

(10) Patent No.: US 10,863,800 B1
(45) Date of Patent: Dec. 15, 2020

(54) FEMALE SNAP ASSEMBLY WITH CAGED ENGAGEMENT MEMBER

(71) Applicant: YKK Corporation of America, Marietta, GA (US)

(72) Inventors: Chuck G. Lecompte, Frankfort, KY (US); Garland Jesse Brock, Lawrenceburg, KY (US); Jonathan H. Sharp, Lawrenceburg, KY (US)

(73) Assignee: YKK Corporation of America, Marietta, GA (US)

( * ) Notice: Subject to any disclaimer, the term of this patent is extended or adjusted under 35 U.S.C. 154(b) by 0 days.

(21) Appl. No.: 16/522,901

(22) Filed: Jul. 26, 2019

(51) Int. Cl.
*A44B 17/00* (2006.01)

(52) U.S. Cl.
CPC ..... *A44B 17/0011* (2013.01); *A44B 17/0076* (2013.01); *A44B 17/0029* (2013.01); *A44B 17/0094* (2013.01)

(58) Field of Classification Search
CPC ..... Y10T 24/366; Y10T 24/45775; Y10T 24/45812; A44B 17/0052; A44B 17/0029; A44B 17/0076; A44B 17/0011; A44B 17/0094
See application file for complete search history.

(56) References Cited

U.S. PATENT DOCUMENTS

| | | | | |
|---|---|---|---|---|
| 6,067,694 | A | 5/2000 | Candotti | |
| 6,170,129 | B1 | 1/2001 | Pferdehirt | |
| 10,278,457 | B2 * | 5/2019 | Hayashi | A44B 17/00 |
| 2010/0139058 | A1 * | 6/2010 | Pferdehirt | A44B 17/0023 24/697.1 |

FOREIGN PATENT DOCUMENTS

| | | | |
|---|---|---|---|
| EP | 2247213 | B1 | 12/2011 |
| EP | 2441340 | B1 | 3/2017 |
| JP | 2013-248233 | A | 12/2013 |
| WO | 2016/079873 | A1 | 11/2014 |

* cited by examiner

*Primary Examiner* — Robert Sandy
(74) *Attorney, Agent, or Firm* — Kilpatrick Townsend & Stockton LLP

(57) ABSTRACT

A female snap assembly includes a cage and an engagement member. The cage defines a receiving region, and the engagement member is within the receiving region. The engagement member includes a base, an inner engagement wall extending from base, and an outer engagement wall extending from the base. In some examples, the engagement member defines a channel between the inner engagement wall and the outer engagement wall. In various examples, the inner engagement wall defines at least one notch extending through the inner engagement wall.

16 Claims, 5 Drawing Sheets

FEMALE SNAP ASSEMBLY WITH CAGED ENGAGEMENT MEMBER

FIELD OF THE INVENTION

This application relates to a snap button, and, more particularly, to a female snap assembly for the snap button with a caged engagement member.

BACKGROUND

Snap buttons are used on a variety of items such as clothing, bags, covers, etc. and generally include a female portion and a male portion that can be selectively engaged or disengaged as desired. Traditionally, the female portion of the snap button has included an annular spring that is loosely incorporated into a receiving area of a cage. The spring is generally formed by cutting and bending a metal or other wire member having a circular cross section. When the male portion is connected with the female portion, a protrusion of the male portion is inserted into the receiving area and into the spring. A tip of the protrusion of the male portion may have a slightly larger diameter than the spring such that as the protrusion is pushed through the spring, the protrusion causes the spring to elastically expand radially outward. After the tip clears the spring, the spring is restored radially inward while holding the protrusion, thereby leading to a connection between the male portion and the female portion.

The spring of the female portion of traditional snap buttons can rattle and generate noise because it is loosely retained in the receiving area of the cage, and such noise can be undesirable in many applications. The female portion of the traditional snap button is also susceptible to debris and material entering the receiving area of the cage and interfering with the engagement between the female portion and the male portion (also known as the snap action).

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings, and each claim.

According to certain embodiments of the present disclosure, a female snap assembly includes a cage and an engagement member. The cage defines a receiving region, and the engagement member is within the receiving region. The engagement member includes a base, an inner engagement wall extending from the base, and an outer engagement wall extending from the base. In some examples, the engagement member defines a channel between the inner engagement wall and the outer engagement wall.

In various embodiments, the base includes an end portion and a body. The end portion of the base includes a perimeter edge, and the perimeter edge is an outer-most perimeter edge of the engagement member. In some examples, the outer engagement wall extends from the end portion of the base at the perimeter edge, and the inner engagement wall extends from the end portion of the base offset from the perimeter edge. In certain examples, the cage includes a base, a side wall extending from the base of the cage, and a rim extending from the side wall of the cage. The base of the cage, the side wall of the cage, and the rim may together define the receiving region, and the rim may overlap a portion of the engagement member such that the engagement member is retained within the receiving region between the rim and the base.

In some embodiments, the base of the engagement member includes an end portion and a body. The body of the base may include a perforating portion and a non-perforating portion, and a thickness of the perforating portion is less than a thickness of the non-perforating portion. In certain aspects, the cage includes a metallic material and the engagement member includes a non-metallic material. In some aspects, the inner engagement wall of the engagement member defines a receiving region of the engagement member, and the inner engagement wall defines at least one notch extending through the inner engagement wall.

According to certain embodiments of the present disclosure, an engagement member for a female snap assembly includes a base. The base includes an end portion and a body, and an engagement wall extends from the end portion of the base. The engagement wall and the body define a receiving region of the engagement member, and the engagement wall may define a notch extending through the engagement wall.

In some embodiments, the engagement wall includes an outer end, and the outer end includes a rib extending from the engagement wall into the receiving region. In various cases, the engagement wall is an inner engagement wall, the engagement member includes an outer engagement wall extending from the end portion, and the engagement member defines a channel between the inner engagement wall and the outer engagement wall. In various examples, the inner engagement wall includes an inner engagement wall height, the outer engagement wall comprises an outer engagement wall height, and the inner engagement wall height is less than the outer engagement wall height.

In various examples, the body includes a perforating portion and a non-perforating portion, and a thickness of the perforating portion is less than a thickness of the non-perforating portion. In some embodiments, the engagement wall includes a engagement wall height, the notch includes a notch height, and the notch height is less than the engagement wall height. In various embodiments, the at least one notch is a first notch of a plurality of notches. Each notch of the plurality of notches may be spaced equidistantly along the engagement wall, although they need not be.

According to certain embodiments of the present disclosure, a female snap assembly includes a cage defining a cage-receiving region and an engagement member within the cage-receiving region. The engagement member includes a base and an engagement wall extending from the base. The engagement wall and a portion of the base may define a member-receiving region. The engagement wall may define at least one notch extending through the engagement wall.

In various embodiments, the engagement wall includes an outer end opposite from the base, and the outer end includes a rib extending from the engagement wall into the member-receiving region. In some examples, the engagement wall is an inner engagement wall, the engagement member includes an outer engagement wall extending from the base, and the engagement member defines a channel between the inner engagement wall and the outer engagement wall. In certain embodiments, the cage includes a base, a side wall extending from the base of the cage, and a rim extending from the side wall of the cage. The base of the cage, the side wall of the cage, and the rim may together define the cage-receiving region. The rim may overlap a portion of the engagement member such that the engagement member is retained within the cage-receiving region between the rim and the base of the cage. In certain embodiments, the cage includes a metallic material and the engagement member includes a non-metallic material.

Various implementations described in the present disclosure can include additional systems, methods, features, and advantages, which cannot necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures can be designated by matching reference characters for the sake of consistency and clarity.

DETAILED DESCRIPTION

Figure 1:
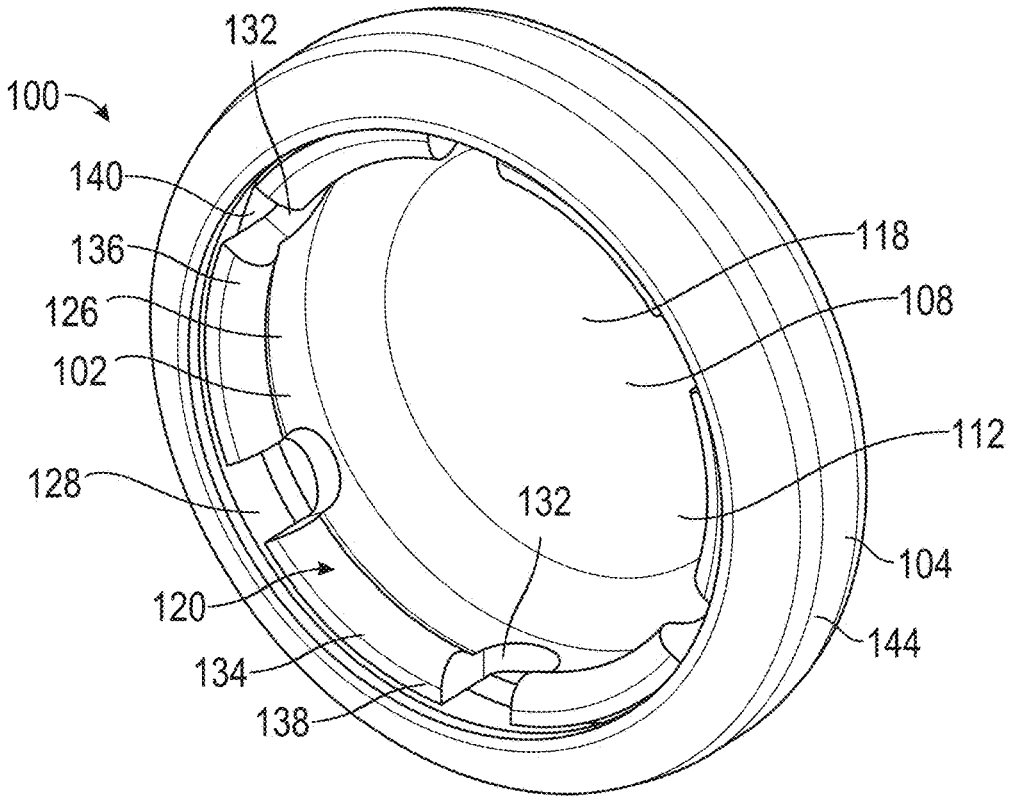
FIG. 1 is a perspective view of a female snap assembly of a snap button that includes an engagement member and a cage according to aspects of the current disclosure.

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described. Directional references such as "up," "down," "top," "bottom," "left," "right," "front," and "back," among others, are intended to refer to the orientation as illustrated and described in the figure (or figures) to which the components and directions are referencing.

FIGS. 1-7 illustrate an example of a female snap assembly 100 for a snap button 101 according to aspects of the current disclosure. The female snap assembly 100 generally includes an engagement member 102 and a cage 104. A male snap component 106 (see FIGS. 5-7) of the snap button 101 may selectively engage the female snap assembly 100. The female snap assembly 100 and the male snap component 106 may be provided on various items such as clothing, bags, or other items to be selectively connected and disconnected via the snap button 101. As explained in greater detail below, the female snap assembly 100 may have improved attachment strength and minimized or reduced rattle (or noise) compared to traditional snap assemblies. The female snap assembly 100 may also have improved corrosion resistance compared to traditional metal snap assemblies. In certain examples, the female snap assembly 100 includes notches and a channel that may allow for the removal of material or debris from a region of the female snap assembly 100 such that the material or debris does not interfere with the snap function of the snap button 101. In other examples, the notches may be omitted.

In certain examples, the engagement member 102 is constructed from a non-metallic material and the cage 104 is constructed from a metallic material, although they need not be in other examples. In one non-limiting example, the engagement member 102 is constructed from a plastic material such as polyoxymethylene (POM), nylon, fiber-reinforced nylon, silicones, rubbers, etc., and the cage 104 is constructed from a metallic material such as brass, aluminum, steel stainless steel, other substrates that can be formed by a stamping process or other suitable process, etc. The different materials used for the engagement member 102 and the cage 104 may minimize or reduce rattling or noise potentially caused by movement of the engagement member 102 relative to the cage 104. The materials used for the engagement member 102 and the cage 104 may further provide improved corrosion resistance while maintaining a relatively consistent snap action in various environments.

The engagement member 102 includes a base 108 having an end portion 110 and a body 112. The end portion 110 of the base 108 includes an outermost edge 114 of the engagement member 102 that defines a perimeter of the engagement member 102. The body 112 of the base 108 has an inner surface 118 that at least partially defines a member-receiving region 120 of the engagement member 102 as described in detail below.

Figure 4:
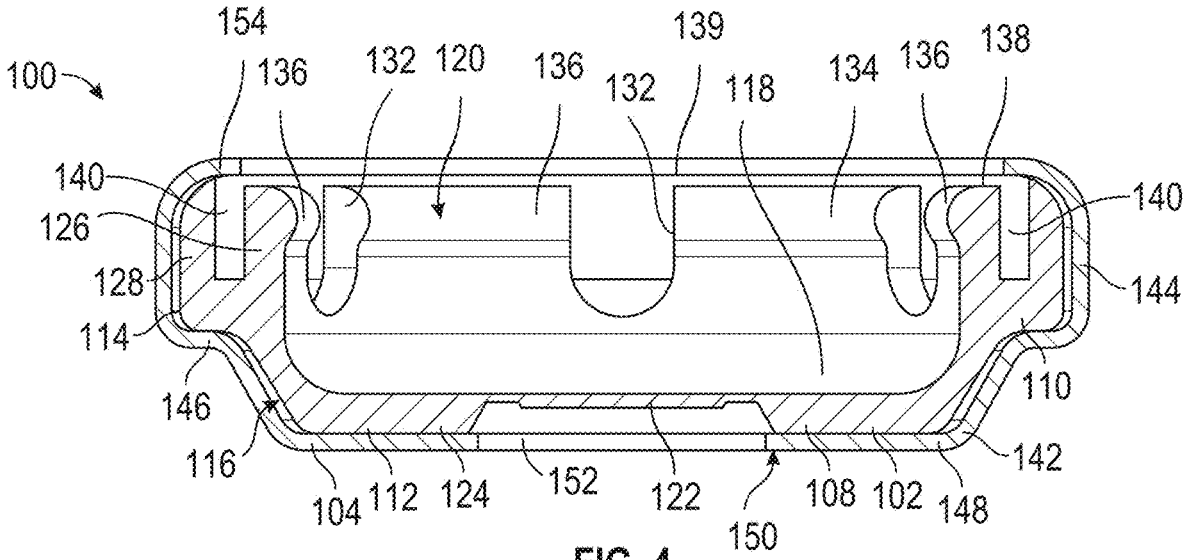
FIG. 4 is a sectional view of the female snap assembly of FIG. 1.
Figure 6:
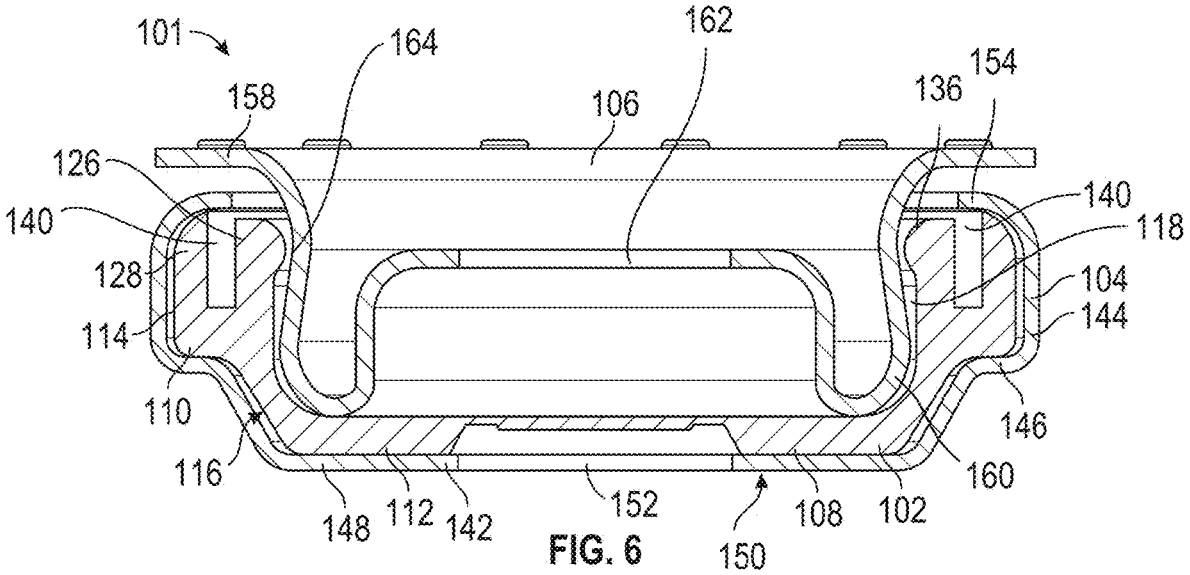
FIG. 6 is a sectional view of the female snap assembly and the male snap component of FIG. 5.

As best illustrated in FIGS. 4 and 6, the body 112 of the base 108 may be offset from the end portion 110 of the base 108 such that a bottom of an outer surface 116 of the base 108 at the end portion 110 is non-coplanar with the bottom of the outer surface 116 of the base 108 at the body 112. In other examples, the end portion 110 and the body 112 may be aligned such that the bottom of the outer surface 116 is substantially planar at the end portion 110 and at the body 112. In various other examples, the base 108 and/or the outer surface 116 may have various other suitable profiles or shapes as desired. Optionally, the body 112 includes a perforating portion 122 and a non-perforating portion 124, and a thickness of the perforating portion 122 may be less than a thickness of the non-perforating portion 124. The reduced thickness of the perforating portion 122 may allow for a post (used to retain the female snap assembly 100 at a desired location such as on an article of clothing, seat, etc.) to pierce the engagement member 102. In some optional examples, the body 112 is continuous and does not define an aperture or other opening through the body 112.

In addition to the base 108, the engagement member 102 includes an inner engagement wall 126 and an outer engagement wall 128 that extend upwardly from the base 108.

In various examples, the outer engagement wall 128 extends upwardly from the end portion 110 of the base 108, although it need not in other examples. In some examples, the outer engagement wall 128 extends upwardly from the end portion 110 at the outermost edge 114, and in such examples, the outer engagement wall 128 may partially define the perimeter of the engagement member 102. In various examples, the outer engagement wall 128 includes an outermost edge defining an outermost perimeter of the engagement member 102, and the outermost edge of the engagement wall is not radially outward (or extending) from the base 108. In certain examples, the outer engagement wall 128 includes a lateral outer surface that is coplanar with a lateral outer surface of the end portion 110.

The inner engagement wall 126 has an outer end 138 and the outer engagement wall 128 has an outer end 139. In some cases, a distance between the outer end 139 and the body 112 is greater than a distance between the outer end 138 and the body 112, although it need not be in other examples. As best illustrated in FIG. 4, the outer engagement wall 128 has a height such that the engagement member 102 is positionable within a cage-receiving region of the cage 104. Optionally, the outer engagement wall 128 may be tapered inwardly as the outer engagement wall 128 extends upwardly away from the base 108, although it need not be in other examples. The tapered outer engagement wall 128 may facilitate retention within and engagement with the cage 104 when the female snap assembly 100 is assembled and thereby reduce potential noise or rattling due to movement of the engagement member 102 relative to the cage 104.

In various examples and similar to the outer engagement wall 128, the inner engagement wall 126 may extend upwardly from the end portion 110 of the base 108, although it need not in other examples. In some examples, the inner engagement wall 126 extends upwardly from the base 108 at a location inward from the outermost edge 114. In various examples, a height of the inner engagement wall 126 is less than a height of the outer engagement wall 128. The reduced height of the inner engagement wall 126 may allow for the cage 104 to protect the inner engagement wall 126 and minimize or reduce potential damage to the inner engagement wall 126.

Figure 2:
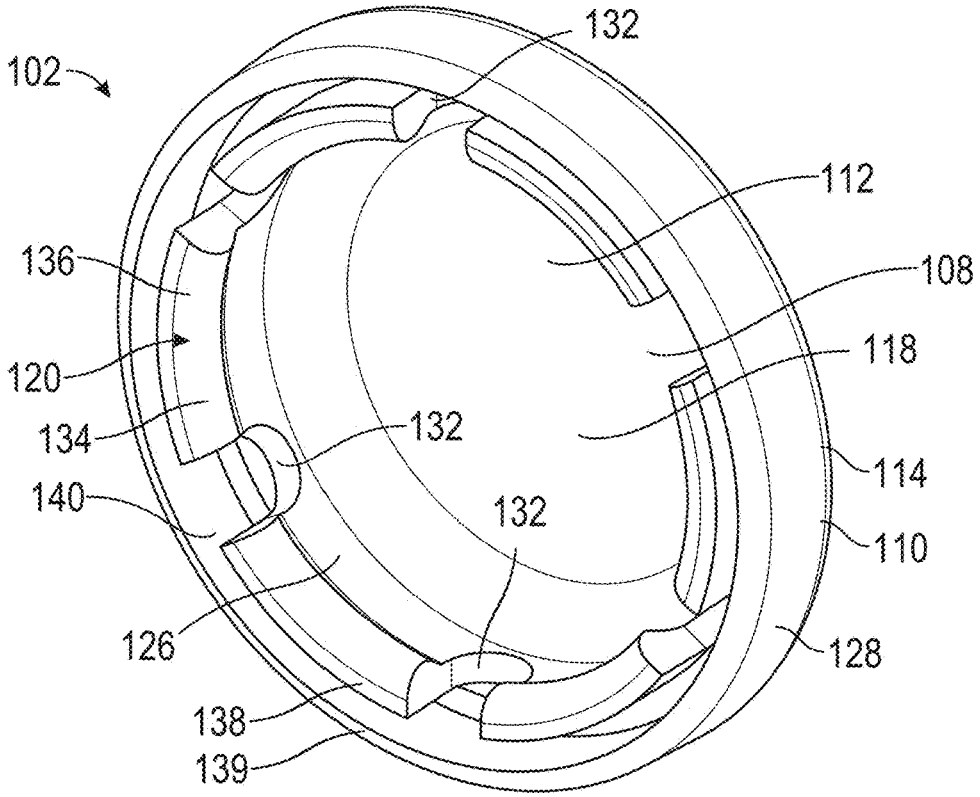
FIG. 2 is a perspective view of the engagement member of FIG. 1.

The inner engagement wall 126 has an inner engagement wall surface 134 that defines the member-receiving region 120 together with the inner surface 118 of the body 112. As illustrated in FIGS. 2 and 4, in some examples, the inner engagement wall 126 includes a rib 136 that extends inwardly from the inner engagement wall surface 134 and into the member-receiving region 120. The rib 136 may extend along at least a portion of a length of the inner engagement wall 126. In various examples, the rib 136 extends from the inner engagement wall surface 134 proximate to or at the outer end 138 of the inner engagement wall 126, although it need not be at the outer end 138 in other examples. The rib 136 may facilitate engagement of the female snap assembly 100 with the male snap component 106 as best illustrated in FIG. 6.

The inner engagement wall 126 optionally defines at least one notch 132 that extends through a thickness of the inner engagement wall 126. In various examples, such as the embodiment illustrated in FIGS. 1-7, the inner engagement wall 126 defines a plurality of notches 132, while in other examples, the notch or notches 132 may be omitted. The shape, size, or number of notches 132 should not be considered limiting on the current disclosure. For example, in some cases, a height of one or more notches 132 may be less than the height of the inner engagement wall 126 or substantially the same as the height of the inner engagement wall 126. Similarly, where a plurality of notches 132 are included, the notches 132 may be provided at regular or irregular intervals along the inner engagement wall 126. As a further example, while the notches 132 in FIGS. 1-7 are illustrated with arcuate surfaces, in other examples, the notches 132 may have planar surfaces, angled surfaces, a saw-tooth profile, other arcuate surfaces, etc. as desired. Moreover, when a plurality of notches 132 are included, the shape or size of one notch 132 may be the same as or different from the shape or size of another notch 132.

In certain examples, the shape, size, and/or number of notches 132 on the inner engagement wall 126 may be controlled to adjust the flexibility of the inner engagement wall 126 and thereby the snap action of the female snap assembly 100. In some examples, the male snap component (made of plastic resin) that engages the female snap assembly 100 (e.g., male snap component 106) may include notches in addition to or in place of the notches 132 to further control the snap tension. For example, an inner engagement wall 126 with a large size notch or notches 132, a large number of notches 132, and/or a particular shape of notches 132 may decrease the tension in the inner engagement wall 126. The decreased tension may provide increased flexibility to the inner engagement wall 126 such that it can flex inwardly or outwardly as desired to accommodate a range of shapes of the male snap component 106. The increased flexibility may also allow for easier engagement or disengagement between the male snap component 106 and the female snap assembly 100. Conversely, an inner engagement wall 126 with a small size notch or notches 132, a small number of notches 132 including the omission of notches 132, and/or a particular shape of notches 132 may increase the tension in the inner engagement wall 126 such that the inner engagement wall 126 is less flexible and more rigid. The decreased flexibility may provide increased engagement between the male snap component 106 and the female snap assembly 100 while reducing the number of profiles that could engage with the female snap assembly 100. As such, by controlling the notches 132, a particular snap action can be obtained.

A channel 140 is defined between the inner engagement wall 126 and the outer engagement wall 128, and the notches 132, if present, are in fluid communication with the channel 140. In various examples, and as illustrated in the figures, the end portion 110 is below the channel 140. In other words, the inner engagement wall 126, the outer engagement wall 128, and the channel 140 are above the end portion 110. The notches 132 and the channel 140 together allow for the passage of materials or objects through the inner engagement wall 126 and into the channel 140 (or vice versa). For example, the channel 140 in communication with the notches 132 facilitates the removal of material or objects from the member-receiving region 120 such that the material or objects do not interfere with the snap function of the female snap assembly 100. Such removal may extend the usable life of the female snap assembly 100 and reduce potential damage to the engagement member 102.

Figure 3:
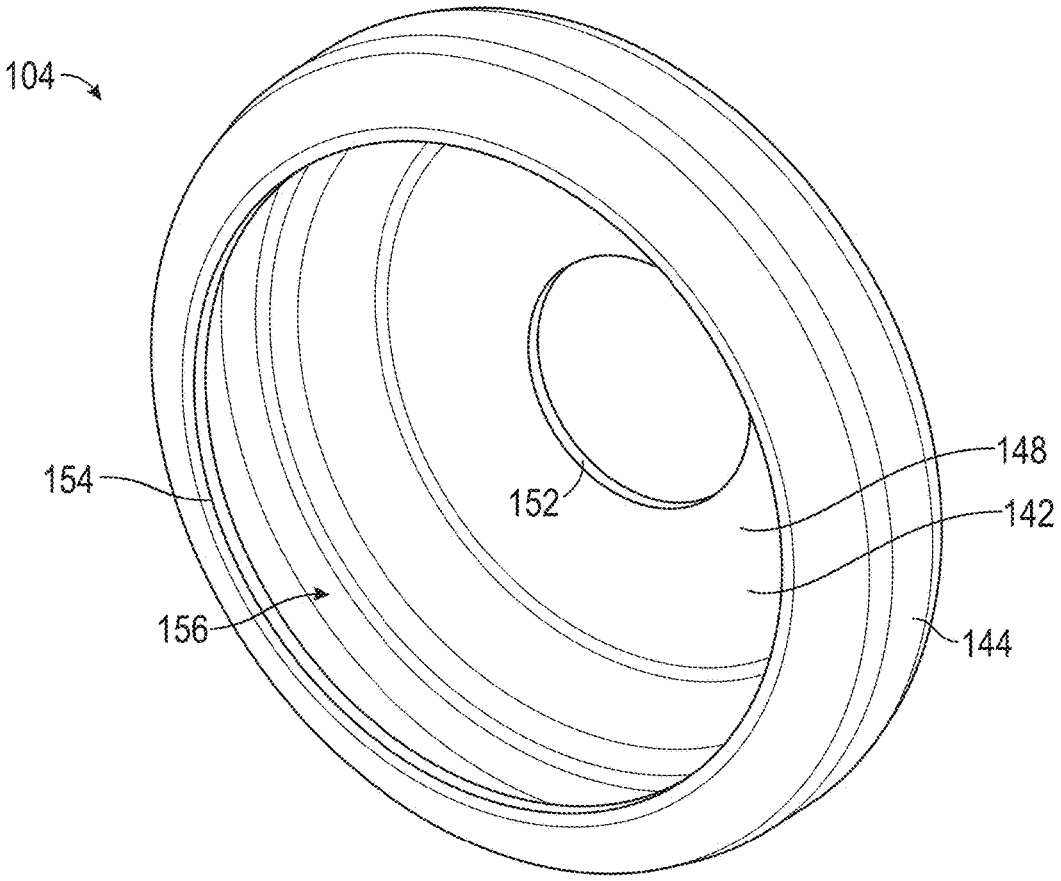
FIG. 3 is a perspective view of the cage of FIG. 1.

The cage 104 includes a base 142 and a side wall 144 extending from the base 142. Similar to the engagement member 102, the base 142 of the cage 104 includes an end portion 146 and a body 148. In some cases, the side wall 144 extends from the end portion 146, although it need not in other examples. In various aspects, the body 148 may be offset from the end portion 146 such that a bottom of an outer surface 150 of the base 142 at the end portion 146 is non-coplanar with the bottom of the outer surface 150 of the base 142 at the body 148. In other examples, the end portion 146 and the body 148 may be aligned such that the bottom of the outer surface 150 is substantially planar. In various other examples, the base 142 and/or the outer surface 150 may have various other suitable profiles or shapes as desired. As best illustrated in FIGS. 3 and 4, the body 148 defines an aperture 152 that is configured to receive the post for the female snap assembly 100. When the cage 104 is assembled with the engagement member 102, the aperture 152 may substantially align with the perforating portion 122 of the engagement member 102.

The side wall 144 includes a rim 154 that extends inwardly from the side wall 144. The rim 154, the side wall 144, and the base 142 together define a cage-receiving region 156 of the cage 104. When the cage 104 and the engagement member 102 are assembled, the engagement member 102 is retained within the cage-receiving region 156. As best illustrated in FIGS. 4 and 6, the side wall 144 and the rim 154 are configured to engage the outer engagement wall 128 of the engagement member 102. The engagement of the side wall 144 and the rim 154 of the cage with the outer engagement wall 128 of the engagement member 102 may minimize or reduce movement of the engagement member 102 relative to the cage 104 and thereby minimize or reduce potential noise or rattling caused by movement of the engagement member 102 relative to the cage 104.

Figure 5:
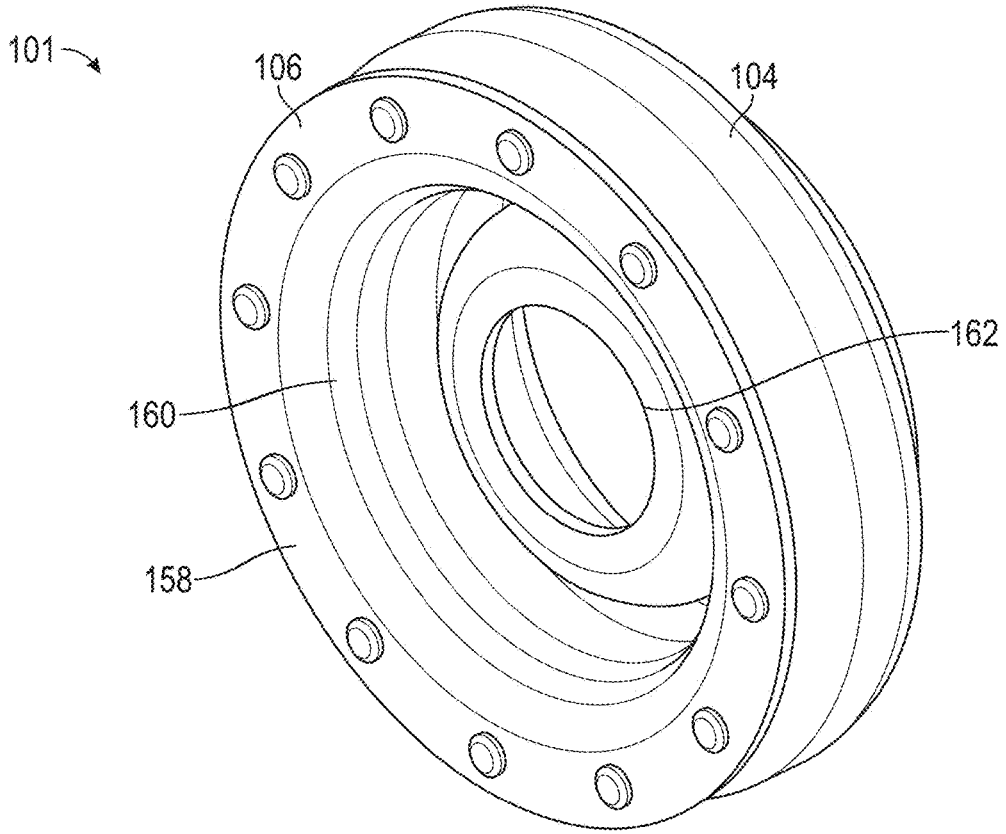
FIG. 5 is a perspective view of the female snap assembly of FIG. 1 engaged with a male snap component of the snap button.
Figure 7:
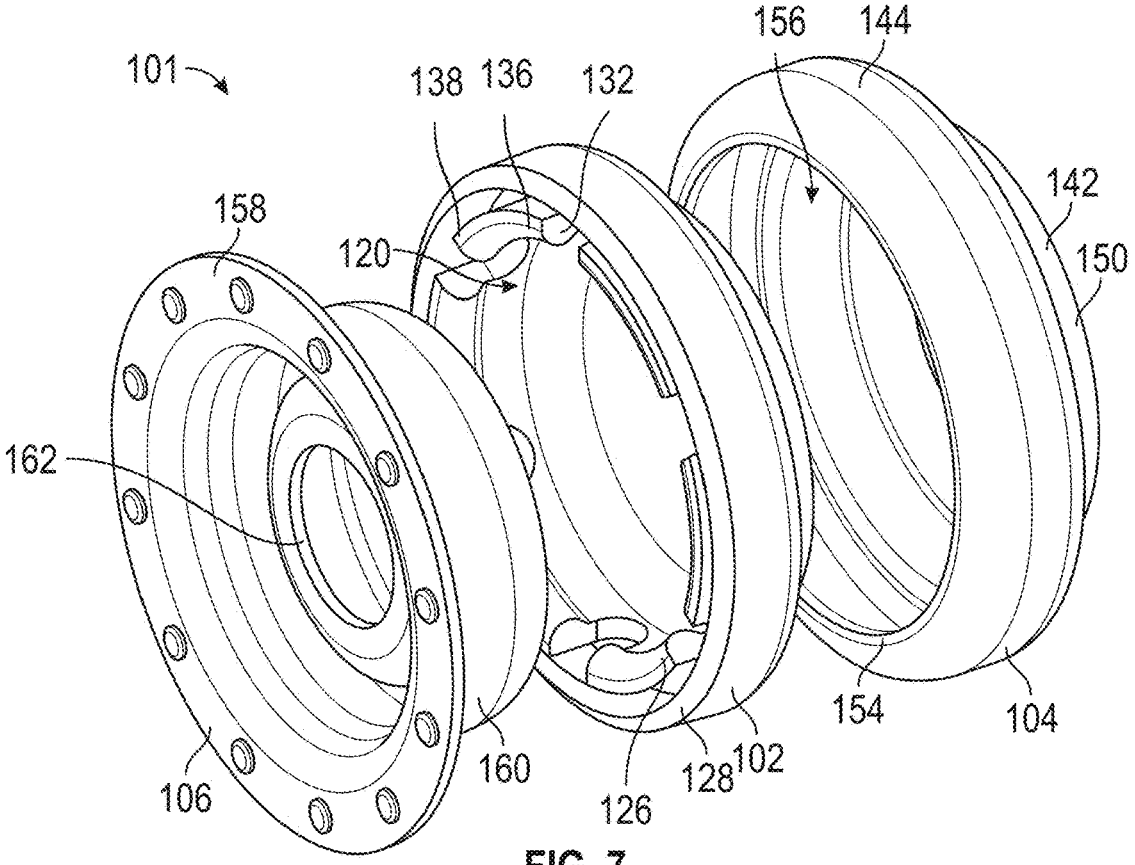
FIG. 7 is an exploded assembly view of the female snap assembly and the male snap component of FIG. 5.
Figure 8:
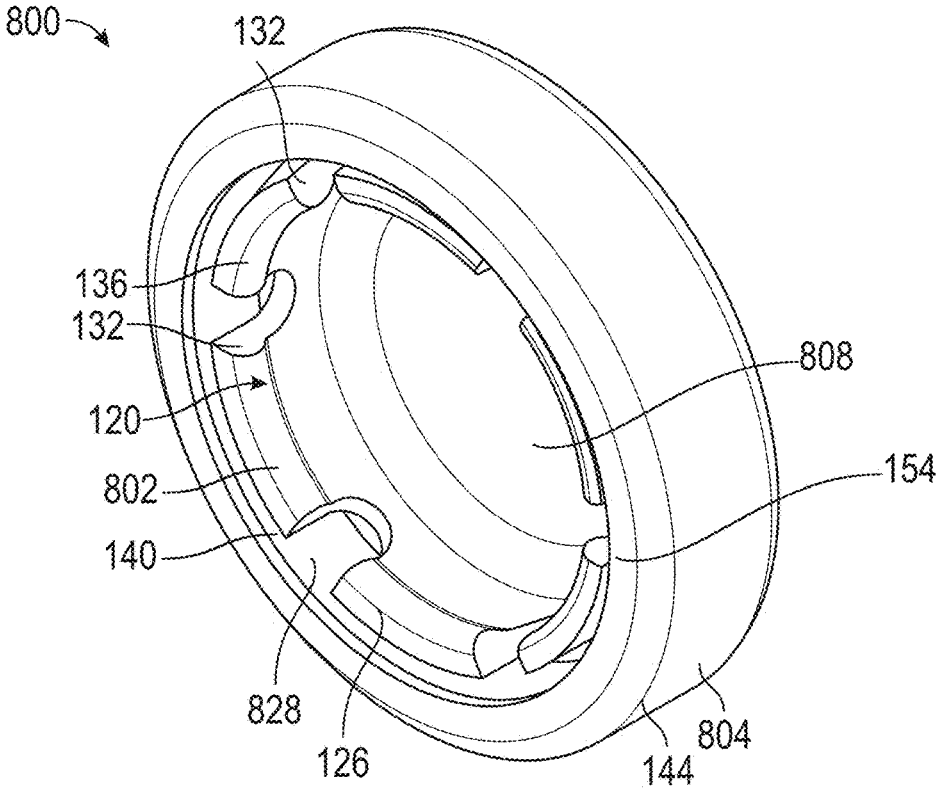
FIG. 8 is a perspective view of a female snap assembly for a snap button that includes an engagement member and a cage according to aspects of the current disclosure.
Figure 10:
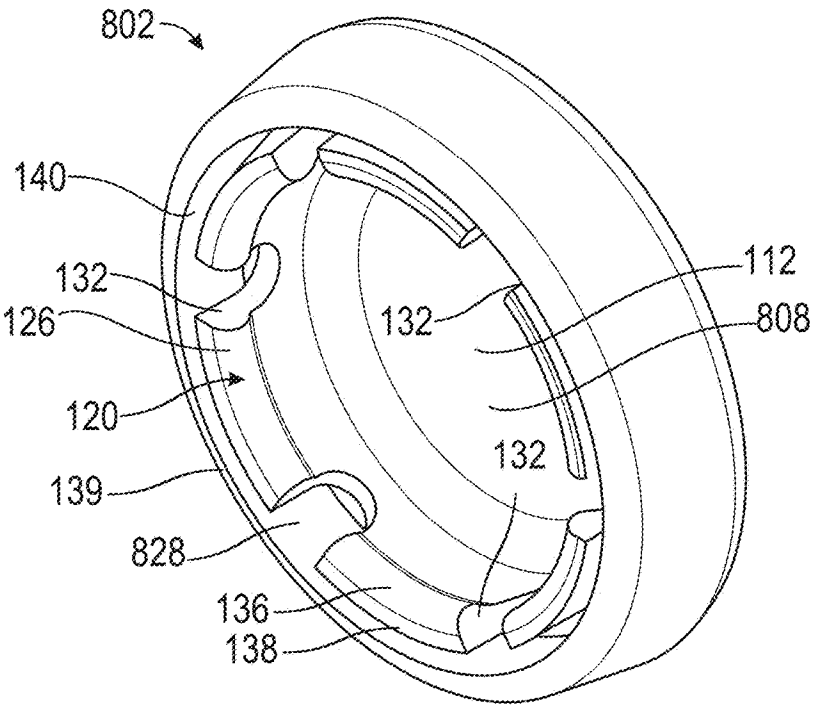
FIG. 10 is a perspective view of the engagement member of FIG. 8.

FIGS. 5-7 illustrate the female snap assembly 100 with the male snap component 106. In FIGS. 5-7, the posts for the female snap assembly 100 and the male snap component, respectively, have been omitted for clarity. The female snap assembly 100 and the male snap component 106 together form the snap button 101, and the female snap assembly 100 and the male snap component 106 can be selectively connected or disconnected as desired.

Generally, the male snap component 106 may include an end portion 158 and a protrusion portion 160. The protrusion portion 160 may include an aperture 162 that receives the post for the male snap component 106. The protrusion portion 160 may optionally include one or more engagement portions 164 that engage the ribs 136 of the engagement member 102. In the example of FIGS. 5-7, the engagement portion 164 is a channel, curvature or indentation on the protrusion portion 160, although other suitable engagement features or mechanisms may be utilized. As best illustrated in FIG. 6, when the male snap component 106 is connected with the female snap assembly 100, the protrusion portion 160 is at least partially positioned within the member-receiving region 120, and the end portion 158 optionally at least partially overlaps the rim 154. The male snap component 106 is provided for illustrative purposes only and should not be considered limiting on the current disclosure, as various other suitable types or configurations of a male snap component may be utilized with the female snap assembly 100 to form the snap button 101.

Figure 11:
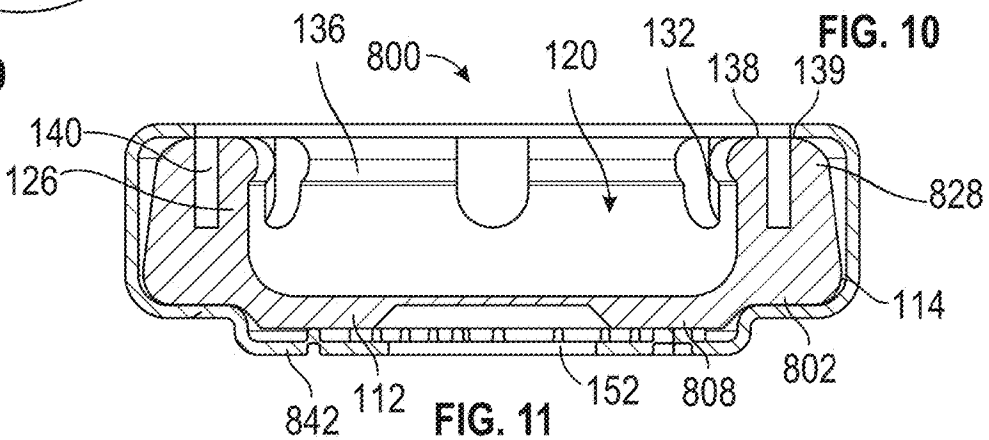
FIG. 11 is a sectional view of the female snap assembly of FIG. 8.
Figure 9:
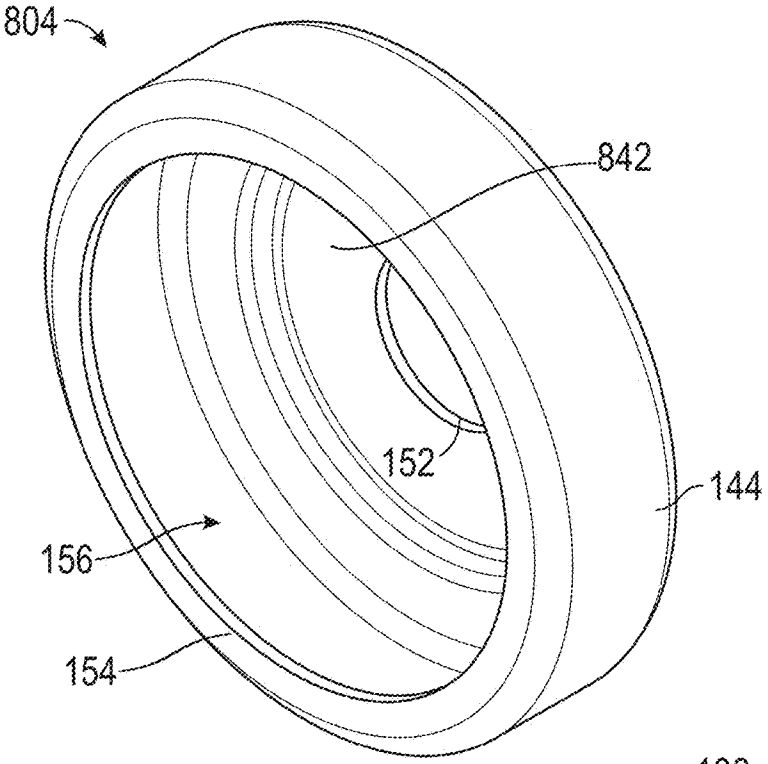
FIG. 9 is a perspective view of the cage of FIG. 8.

FIGS. 8-11 illustrate another example of a female snap assembly 800 that is substantially similar to the female snap assembly 100 except that the profile of the base 808 of the engagement member 802 is different compared to the base 108, the profile of the base 842 of the cage 804 is different compared to the base 142, and the profile of the outer engagement wall 828 of the engagement member 802 is different compared to the outer engagement wall 128 such that there is less contact between the outer engagement wall 128 and the cage 804. For example, in FIGS. 8-11, the outer engagement wall 828 tapers inwards as the outer engagement wall 828 extends upwardly from the engagement member 802. In some optional cases, and as best illustrated in FIG. 11, the outermost edge 114 of the base 808 is the outermost perimeter edge of the engagement member 802 such that the outer engagement wall 828 does not extend outwardly beyond the outermost edge 114 (i.e., the outermost edge 114 is the radially outmost portion of the engagement member 802). In various cases, the outermost edge 114 is the radially outermost portion of the engagement member 802 between the outer end 138 (and/or the outer end 139) and the body 112.

A collection of exemplary embodiments, including at least some explicitly enumerated as "Examples," providing additional description of a variety of embodiment types in accordance with the concepts described herein are provided below. These examples are not meant to be mutually exclusive, exhaustive, or restrictive; and the invention is not limited to these example embodiments but rather encompasses all possible modifications and variations within the scope of the issued claims and their equivalents.

Example 1. A female snap assembly for a snap button, the female snap assembly comprising: a cage defining a receiving region; and an engagement member comprising: a base; an inner engagement wall extending from base; an outer engagement wall extending from the base; and a channel between the inner engagement wall and the outer engagement wall, wherein the base, the inner engagement wall, and the outer engagement wall are retained within the receiving region of the cage.

Example 2. The female snap assembly of any preceding or subsequent examples or combination of examples, wherein the base comprises an end portion and a body, wherein the end portion comprises an outermost edge defining a perimeter of the engagement member.

Example 3. The female snap assembly of any preceding or subsequent examples or combination of examples, wherein the outer engagement wall extends from the end portion at the outermost edge, and wherein the inner engagement wall extends from the end portion offset from the outermost edge.

Example 4. The female snap assembly of any preceding or subsequent examples or combination of examples, wherein the cage comprises: a base; a side wall extending from the base of the cage; and a rim extending from the side wall of the cage, wherein the base of the cage, the side wall of the cage, and the rim together define the receiving region, and wherein the rim overlaps a portion of the engagement member such that the engagement member is retained within the receiving region between the rim and the base.

Example 5. The female snap assembly of any preceding or subsequent examples or combination of examples, wherein the base of the engagement member comprises an end portion and a body, wherein the body comprises a perforating portion and a non-perforating portion, and wherein a thickness of the perforating portion is less than a thickness of the non-perforating portion.

Example 6. The female snap assembly of any preceding or subsequent examples or combination of examples, wherein the cage comprises a metallic material, and wherein the engagement member comprises a non-metallic material.

Example 7. The female snap assembly of any preceding or subsequent examples or combination of examples, wherein the inner engagement wall of the engagement member defines a receiving region of the engagement member, and wherein the inner engagement wall defines at least one notch extending through the inner engagement wall.

Example 8. An engagement member for a female snap assembly, the engagement member comprising: a base comprising an end portion and a body; and an engagement wall extending from the end portion of the base, wherein the engagement wall and the body define a receiving region of the engagement member, wherein the engagement wall defines at least one notch.

Example 9. The engagement member of any preceding or subsequent examples or combination of examples, wherein the engagement wall further comprises an outer end, and wherein the outer end comprises a rib extending from the engagement wall into the receiving region.

Example 10. The engagement member of any preceding or subsequent examples or combination of examples, wherein the engagement wall is an inner engagement wall, wherein the engagement member further comprises an outer engagement wall extending from the end portion, and a channel between the inner engagement wall and the outer engagement wall.

Example 11. The engagement member of any preceding or subsequent examples or combination of examples, wherein the inner engagement wall comprises an inner engagement wall height, wherein the outer engagement wall comprises an outer engagement wall height, and wherein the inner engagement wall height is less than the outer engagement wall height.

Example 12. The engagement member of any preceding or subsequent examples or combination of examples, wherein the body comprises a thickness, and wherein the thickness of a perforating portion of the body is less than the thickness of a non-perforating portion of the body.

Example 13. The engagement member of any preceding or subsequent examples or combination of examples, wherein the engagement wall comprises a engagement wall height, wherein the notch comprises a notch height, and wherein the notch height is less than the engagement wall height.

Example 14. The engagement member of any preceding or subsequent examples or combination of examples, wherein the at least one notch is a first notch of a plurality of notches.

Example 15. The engagement member of any preceding or subsequent examples or combination of examples, wherein each notch of the plurality of notches is spaced equidistantly along the engagement wall.

Example 16. The engagement member of any preceding or subsequent examples or combination of examples, wherein: the engagement wall is an inner engagement wall; the engagement member further comprises an outer engagement wall extending from the end portion and extending around the inner engagement wall; and the end portion comprises an outermost edge defining an outermost perimeter of the engagement member such that the outermost edge is radially outward from the outer engagement wall.

Example 17. A female snap assembly for a snap button, the female snap assembly comprising: a cage defining a cage-receiving region; and an engagement member within the cage-receiving region, wherein the engagement member comprises: a base; and an engagement wall extending from the base, wherein the engagement wall and a portion of the base define a member-receiving region, and wherein the engagement wall defines at least one notch.

Example 18. The female snap assembly of any preceding or subsequent examples or combination of examples, wherein the engagement wall further comprises an outer end opposite from the base, and wherein the outer end comprises a rib extending from the engagement wall into the member-receiving region.

Example 19. The female snap assembly of any preceding or subsequent examples or combination of examples, wherein the engagement wall is an inner engagement wall, wherein the engagement member further comprises an outer engagement wall extending from the base, and a channel between the inner engagement wall and the outer engagement wall.

Example 20. The female snap assembly of any preceding or subsequent examples or combination of examples, wherein the cage comprises: a base; a side wall extending from the base of the cage; and a rim extending from the side wall of the cage, wherein the base of the cage, the side wall of the cage, and the rim together define the cage-receiving region, and wherein the rim overlaps a portion of the engagement member such that the engagement member is retained within the cage-receiving region between the rim and the base of the cage.

Example 21. The female snap assembly of any preceding or subsequent examples or combination of examples, wherein the cage comprises a metallic material, and wherein the engagement member comprises a non-metallic material.

Example 22. The engagement member of any preceding or subsequent examples or combination of examples, wherein: the engagement wall is an inner engagement wall; the engagement member further comprises an outer engagement wall extending from the end portion and extending around the inner engagement wall, wherein the outer engagement wall comprises an outermost edge defining an outermost perimeter of the engagement member; and the end portion comprises an outermost edge defining an outermost perimeter of the engagement member such that the outermost edge of the end portion is coplanar with or radially outward from the outermost edge of the outer engagement wall.

Example 23. The female snap assembly of any preceding or subsequent examples or combination of examples, wherein the base comprises an end portion and a body, wherein the end portion comprises an outermost edge defining a perimeter of the engagement member, wherein the outer engagement wall comprises an outermost edge defining an outermost perimeter of the engagement member, and wherein the outermost edge of the outer engagement wall is not radially outward from the outermost edge of the end portion.

The above-described aspects are merely possible examples of implementations, merely set forth for a clear understanding of the principles of the present disclosure. Many variations and modifications can be made to the above-described embodiment(s) without departing substantially from the spirit and principles of the present disclosure. All such modifications and variations are intended to be included herein within the scope of the present disclosure, and all possible claims to individual aspects or combinations of elements or steps are intended to be supported by the present disclosure. Moreover, although specific terms are employed herein, as well as in the claims that follow, they are used only in a generic and descriptive sense, and not for the purposes of limiting the described invention, nor the claims that follow.

That which is claimed:

1. A female snap assembly for a snap button, the female snap assembly comprising:

a cage defining a receiving region; and an engagement member comprising:

a base;

an inner engagement wall extending from base;

an outer engagement wall extending from the base; and a channel between the inner engagement wall and the outer engagement wall, wherein the base, the inner engagement wall, and the outer engagement wall are retained within the receiving region of the cage, and wherein the base of the engagement member comprises an end portion and a body, wherein the body comprises a perforating portion and a non-perforating portion, and wherein a thickness of the perforating portion is less than a thickness of the non-perforating portion.

2. The female snap assembly of claim 1, wherein the end portion comprises an outermost edge defining a perimeter of the engagement member, wherein the outer engagement wall comprises an outermost edge defining an outermost perimeter of the engagement member, and wherein the outermost edge of the outer engagement wall is not radially outward from the outermost edge of the end portion.

3. The female snap assembly of claim 2, wherein the outer engagement wall extends from the end portion at the outermost edge, and wherein the inner engagement wall extends from the end portion offset from the outermost edge.

4. The female snap assembly of claim 1, wherein the cage comprises:

a base;

a side wall extending from the base of the cage; and a rim extending from the side wall of the cage, wherein the base of the cage, the side wall of the cage, and the rim together define the receiving region, and wherein the rim overlaps a portion of the engagement member such that the engagement member is retained within the receiving region between the rim and the base.

5. The female snap assembly of claim 1, wherein the cage comprises a metallic material, and wherein the engagement member comprises a non-metallic material.

6. The female snap assembly of claim 1, wherein the inner engagement wall of the engagement member defines a receiving region of the engagement member, and wherein the inner engagement wall defines at least one notch extending through the inner engagement wall.

7. An engagement member for a female snap assembly, the engagement member comprising:

a base comprising an end portion and a body; and an engagement wall extending from the end portion of the base, wherein the engagement wall and the body define a receiving region of the engagement member, wherein the engagement wall defines at least one notch, wherein the engagement wall is an inner engagement wall, wherein the engagement member further comprises an outer engagement wall extending from the end portion, and a channel between the inner engagement wall and the outer engagement wall, and wherein the inner engagement wall comprises an inner engagement wall height, wherein the outer engagement wall comprises an outer engagement wall height, and wherein the inner engagement wall height is less than the outer engagement wall height.

8. The engagement member of claim 7, wherein the inner engagement wall further comprises an outer end, and wherein the outer end comprises a rib extending from the engagement wall into the receiving region.

9. The engagement member of claim 7, wherein the body comprises a thickness, and wherein the thickness of a perforating portion of the body is less than the thickness of a non-perforating portion of the body.

10. The engagement member of claim 7, wherein the inner engagement wall comprises an inner engagement wall height, wherein the notch comprises a notch height, and wherein the notch height is less than the inner engagement wall height.

11. The engagement member of claim 7, wherein the at least one notch is a first notch of a plurality of notches.

12. The engagement member of claim 7, wherein:

the outer engagement wall comprises an outermost edge defining an outermost perimeter of the engagement member; and the end portion comprises an outermost edge defining an outermost perimeter of the engagement member such that the outermost edge of the end portion is coplanar with or radially outward from the outermost edge of the outer engagement wall.

13. An engagement member for a female snap assembly, the engagement member comprising:

a base comprising an end portion and a body; and an engagement wall extending from the end portion of the base, wherein the engagement wall and the body define a receiving region of the engagement member, wherein the engagement wall defines at least one notch, and wherein the body comprises a thickness, and wherein the thickness of a perforating portion of the body is less than the thickness of a non-perforating portion of the body.

14. The engagement member of claim 13, wherein the engagement wall further comprises an outer end, and wherein the outer end comprises a rib extending from the engagement wall into the receiving region.

15. The engagement member of claim 13, wherein the engagement wall comprises an engagement wall height, wherein the notch comprises a notch height, and wherein the notch height is less than the engagement wall height.

16. The engagement member of claim 13, wherein the at least one notch is a first notch of a plurality of notches.

* * * * *